United States Patent [19]

Bando

[11] Patent Number: 5,039,288

[45] Date of Patent: Aug. 13, 1991

[54] ROTARY ENGINE HAVING AN APEX SEAL MEMBER

[75] Inventor: Yoshihiro Bando, Tokushima, Japan

[73] Assignee: Bando Kiko Co., Limited, Tokushima, Japan

[21] Appl. No.: 518,338

[22] Filed: May 3, 1990

Related U.S. Application Data

[63] Continuation of Ser. No. 204,458, Jun. 8, 1988, abandoned.

Foreign Application Priority

[30] Jun. 7, 1988 [JP] Japan ..... PCT/JP88/00548

[51] Int. Cl.[5] ..... F01C 1/22; F01C 19/04

[52] U.S. Cl. ..... 418/123; 418/235

[58] Field of Search ..... 418/113, 122–124, 418/235, 114–121

[56] References Cited

U.S. PATENT DOCUMENTS

| | | | |
|---|---|---|---|
| 2,048,825 | 7/1936 | Smelser | 418/235 |
| 2,536,938 | 1/1951 | Hunter | 418/235 |
| 3,033,180 | 5/1962 | Bentele | 418/123 |
| 3,226,013 | 12/1965 | Toyoda et al. | 418/122 |
| 3,277,873 | 10/1966 | Brodbeck et al. | 418/122 |
| 3,785,745 | 1/1974 | Lamm | 418/113 |
| 3,961,871 | 6/1976 | Kurio | 418/121 |
| 4,329,129 | 5/1982 | Ishizuka et al. | 418/235 |

FOREIGN PATENT DOCUMENTS

| | | | |
|---|---|---|---|
| 1135708 | 8/1962 | Fed. Rep. of Germany | 418/121 |
| 40-22284 | 10/1965 | Japan . | |
| 41-10563 | 6/1966 | Japan . | |
| 46-10966 | 4/1971 | Japan . | |
| 46-27125 | 9/1971 | Japan . | |
| 46-36642 | 10/1971 | Japan . | |
| 47-34410 | 8/1972 | Japan . | |
| 47-50524 | 12/1972 | Japan . | |
| 50-32307 | 3/1975 | Japan . | |
| 50-155407 | 12/1975 | Japan . | |
| 51-43296 | 10/1976 | Japan . | |
| 55-4928 | 2/1980 | Japan . | |
| 58-120802 | 8/1983 | Japan . | |
| 60-18201 | 2/1985 | Japan . | |
| 60-54702 | 4/1985 | Japan . | |
| 60-67701 | 4/1985 | Japan . | |
| 60-19921 | 6/1985 | Japan . | |
| 60-206901 | 10/1985 | Japan . | |
| 62-121802 | 6/1987 | Japan . | |
| 62-129501 | 6/1987 | Japan . | |
| 62-150004 | 7/1987 | Japan . | |
| 62-248802 | 10/1987 | Japan . | |
| 63-5119 | 1/1988 | Japan . | |
| 63-38601 | 2/1988 | Japan . | |
| 967157 | 8/1964 | United Kingdom . | |

OTHER PUBLICATIONS

Patent Abstracts of Japan, vol. 6, No. 20 (M-110)[898], Feb. 5, 1982; & JP-A-56 138 402 (Ebara Seisakusho K.K.)29-10-1981.

*Primary Examiner*—John J. Vrablik

*Attorney, Agent, or Firm*—Nixon & Vanderhye

[57] ABSTRACT

A rotary engine is disclosed which comprises a rotor housing, a rotor fitted in the rotor housing so as to define a plurality of operating chambers in cooperation with the inner wall surface of the rotor housing and produce a planetary rotation of itself inside the rotor housing, apex seal members severally accommodated inside seal grooves formed at the apexes of the rotor along the axis of rotation of said rotor, and pressure means disposed between the respective apex seal members and the rotor so as to press the apex seal members against the inner wall surface of the rotor housing by virtue of the pressure of a gas emanating from the operating chambers.

9 Claims, 9 Drawing Sheets

ROTARY ENGINE HAVING AN APEX SEAL MEMBER

This is a continuation of application Ser. No. 07/204,458 filed June 8, 1988 now abandoned.

BACKGROUND OF THE INVENTION

1. Field of the Invention

This invention relates to a rotary engine having improvements embodied in the apex seal parts which are attached to the apexes of the rotor thereof.

2. State of the Prior Art

Generally, the rotary engine has the rotor thereof disposed inside a rotor housing having a trochoidal inner wall surface formed with a major diameter part and a minor diameter part and has operating chambers partitioned and mutually sealed off by the apex seal members embedded one each in the grooves formed at the apexes of the rotor along the axis of rotation of the rotor.

This rotary engine, for the purpose of keeping the adjacent operating chambers in a mutually sealed or airtight condition while the rotor is generating a planetary rotation inside the rotor housing, is required to be provided with such apex seal members as are capable of producing a motion sensitively and infallibly relative to the radial direction of the rotor.

Particularly, of the two apex seal members which happen to seal an operating chamber held in a state involving the stroke of compression to the stroke of explosive combustion, the apex seal member existing on the front side in the direction of advance relative to the rotation of the rotor is liable to suffer leakage of the compressed gas or the combustion gas from the operating chamber under discussion. The apex seal member on the front side, therefore, is required to produce all the more reliable sealing motion.

In the light of the true state of affairs of the prior art described above, the present invention aims to provide a rotary engine so constructed that the apex seal members thereof, during the planetary rotation of the rotor thereof, are enable to produce a motion sensitively and infallible relative to the radial direction of the rotor and maintain contact in a desirable state with the sliding surface of the rotor housing and keep the adjacent operating chambers both in a perfectly airtight state.

SUMMARY OF THE INVENTION

The object described above is accomplished by a rotary engine, comprising a rotor housing having an inner wall surface, a rotor disposed rotatably in the rotary housing so as to define a plurality of operating chambers in cooperation with the inner wall surface of the rotary housing, said rotor having apexes and seal grooves formed in said apexes respectively along the axis of rotation of the rotor, an apex seal member accommodated inside one of said seal grooves, and pressing means disposed between said respective apex seal member and the rotor so as to press the apex seal member against the inner wall surface of the rotor housing by virtue of the pressure of a gas emanating from the operating chambers.

Now, preferred embodiments of this invention will be described below with reference to the accompanying drawings.

DESCRIPTION OF THE PREFERRED EMBODIMENTS

Figure 1:
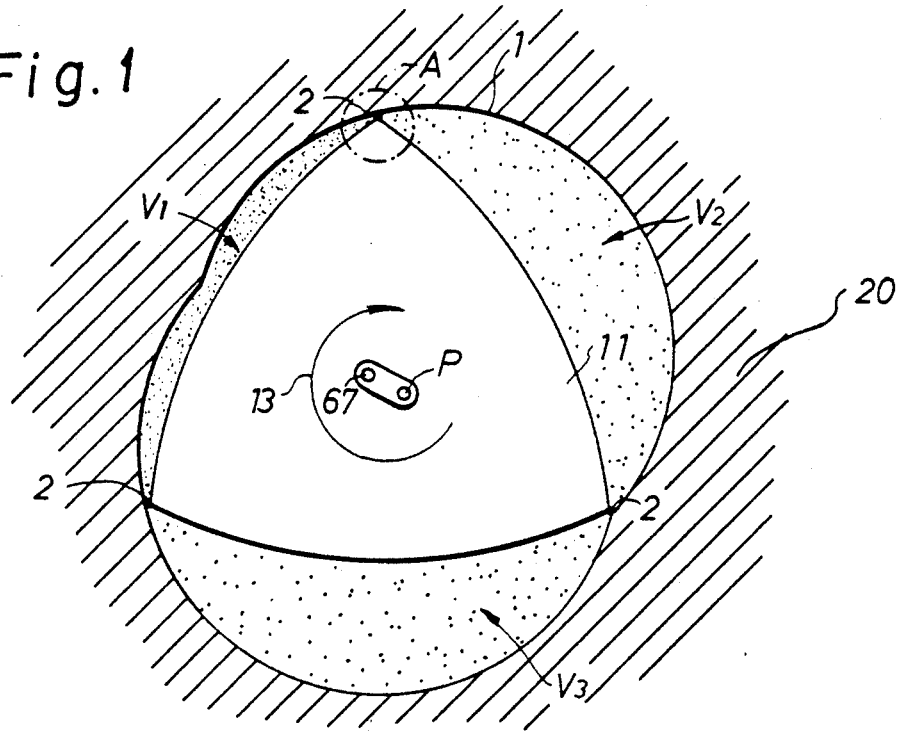
FIG. 1 is a front cross-sectional view of a rotary engine.

FIG. 1 is a diagram illustrating in cross section a rotary engine.

First, the various forces generally exerted on individual apex seal members while a rotor 11 is kept in planetary rotation will be described with reference to FIG. 1, FIG. 2, FIG. 3, FIG. 4, and FIG. 5.

Figure 2:
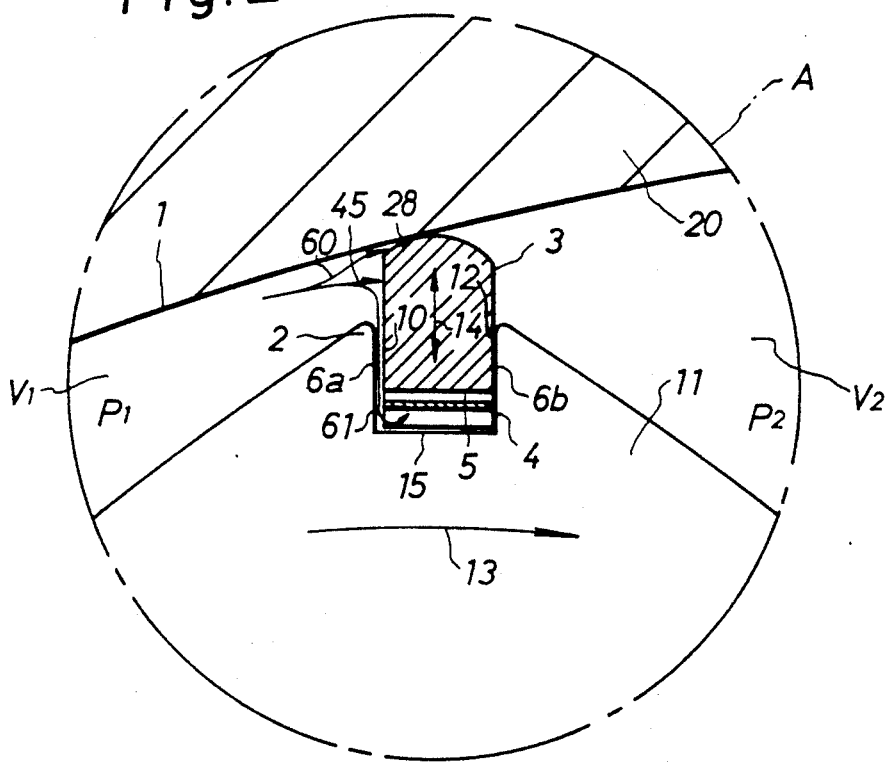
FIG. 2, FIG. 3, FIG. 4, and FIG. 5 are explanatory diagrams illustrating the manner of exertion of force upon an apex seal member.

As shown in FIG. 2 which illustrates as magnified the portion A indicated in FIG. 1, an apex seal member 3 is fitted in a seal groove 4 which is formed at an apex 2 of the rotor 11. In the apex seal member 3 set in place as described above, a flow of gas indicated by an arrow 45 (FIG. 2), having a pressure P1, and emanating from an operating chamber V1 held in a state of high pressure exerts a pressing force on one of the lateral sides 10 of the apex seal member 3 facing to the operating chamber V1 and causes the other lateral side 12 facing to an adjacent operating chamber V2 to be strongly pressed against one of the wall surfaces **6*b* of the seal groove 4 situated on the operating chamber V2 side, with the result that the movement of the apex seal member 3** relative to the radial direction indicated by an arrow 14 is dulled to a great extent.

Figure 3:
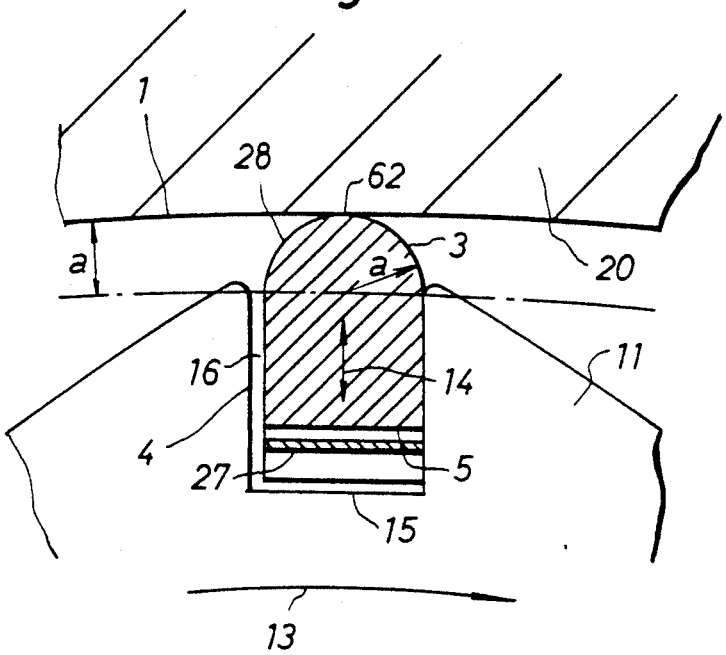

Further, while the apex seal member 3 is positioned on the front side in the direction of advance relative to the rotation of the rotor 11 indicated by an arrow 13 in FIG. 2, since a top surface 28 of the apex seal member 3 is depressed toward a bottom surface 15 of the seal groove 4 and, at the same time, the other lateral side 12 facing to the operating chamber V2 is strongly pressed against wall surface 6b of the seal groove 4 on the side of the operating chamber V2 by the pressing force exerted inwardly in the radial direction indicated by the arrow 14 by the gas flow indicated by an arrow 60, having a pressure P1, and emanating from the operating chamber V1 held in a state of high pressure, the apex seal member 3 assumes a state of being locked by the frictional resistance generated between the lateral side 12 and the wall surface 6*b*. Thus insufficient contact is established between the top surface 28 and the sliding surface 1 of the rotor housing 20, i.e., a gap occurs between the top surface 28 and the sliding surface 1, and gas and pressure P1 passes from the operating chamber V1 to the operating chamber V2 via the gap. Further, the apex seal member 3 of the foregoing description has the top surface 28 thereof shaped in an arched surface which, as illustrated in FIG. 3, has as the radius of curvature thereof the amount "a" of amplitude of the reciprocating motion produced by the top surface 28 relative to the direction indicated by the arrow 14 when the top surface 28 is moved as reciprocated parallel to the sliding surface 1 (trochoidal inner wall surface) of the rotor housing 20. Since the apex seal member 3 is constructed as described above, a part 62 of the top surface 28 which contacts the sliding surface 1 is continuously moved over the entire arcuate surface of the top surface 28 in consequence of the rotation of the rotor 11 to induce uniform abrasion of the top surface 28 and enhance the wear resistance of the apex seal member 3.

Moreover, a spring 27 interposed between a bottom part 5 of the apex seal member 3 and the bottom surface 15 of the seal groove 4 exerts on the apex seal member 3 a pressing force produced outwardly in the radial direction indicated by the arrow 14.

Figure 4:
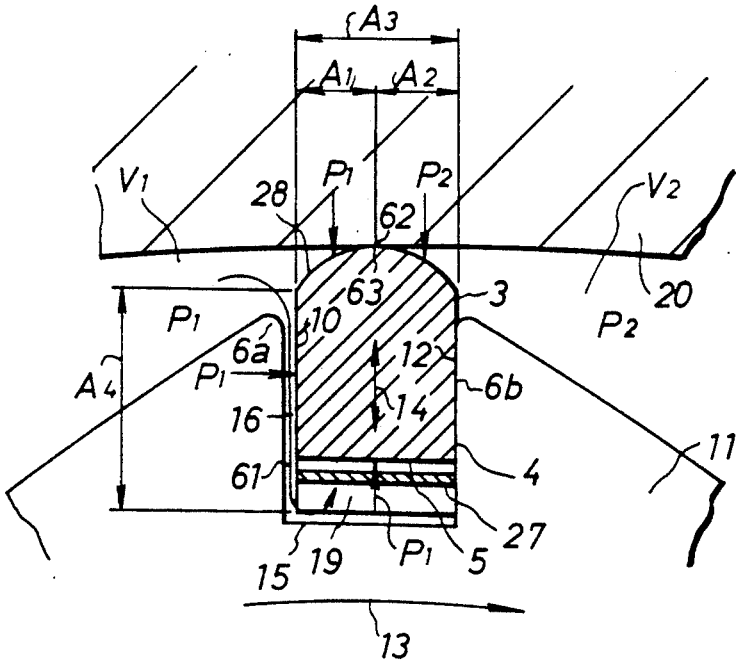

As illustrated in FIG. 4, while the rotor 11 is rotated inside the rotor housing 20 in the direction of the arrow 13, the inertial force originating in the centrifugal force generated outwardly in the radial direction indicated by the arrow 14 from the center P (FIG. 1) of rotation of the rotor 11 and accelerated in direct proportion to the rotational speed of the rotor 11 is exerted upon the apex seal member 3. Further, the gas pressure P1 is maintained inside the operating chamber V1 and the gas pressure P2 is maintained inside the operating chamber V2 (P1>P2). On the apex seal member 3 are further exerted the combustion gas pressure indicated by an arrow 61 and transmitted from the operating chamber V1 through a passage 16 formed between the lateral side 10 of the apex seal member 3 and a wall surface 6*a* of the seal groove 4 and then through a chamber 19. In this way, the compressed gas pressure, namely the pressing force produced by the pressure P1 of the gas inside the operating chamber V1 is exerted on the bottom part 5 of the apex seal member 3 outwardly in the radial direction indicated by the arrow 14 from the center P of rotation of the rotor 11 (FIG. 1). The pressing force by the pressure P1 of the gas described above is acting in a large proportion on the apex seal member 3. The force, F, which is acting on the entirety of the apex seal member 3 is expressed by the following formula:

$$F = P1A3 - (P1A1 + P2A2) - \mu P1A4$$

wherein P1 stands for the inner pressure of the compression-combustion side operating chamber (high pressure side), P2 for the inner pressure of the exhaust side operating chamber (low pressure side), A1 for the pressure-receiving area of the top surface 28 of the apex seal member 3 on which the pressure P1 acts, A2 for the pressure-receiving area of the top surface 28 of the apex seal member 3 on which the pressure P2 acts, A3 for the pressure-receiving area of the bottom part 5 of the apex seal member 3 on which the pressure P1 acts, A4 for the pressure-receiving area of the lateral side 10 of the apex seal member 3 on which the pressure P1 acts, and $\mu$ for the friction coefficient between the lateral side 12 of the apex seal member 3 and the wall surface 6b of the seal groove 4.

The term "P1A3" in the formula represents the force which, by virtue of the gas pressure P1 introduced via the passage 16 into the chamber 19 of the seal groove 4, pushes up the apex seal member 3 outwardly in the radial direction indicated by the arrow 14 and causes the top surface 28 of the apex seal member 3 to come into sealing contact with the sliding surface 1 of the rotor housing 20.

The term "P1A1+P2A2" in the formula represents the force which acts on the top surface 28 of the apex seal member 3 to depress the apex seal member 3 inwardly in the radial direction indicated by the arrow 14 and tend to separate the top surface 28 from the sliding surface 1 of the rotor housing 20.

The term "$\mu$P1A4" in the formula represents the sliding friction resistance which is generated between the lateral side 12 of the apex seal member 3 and the wall surface 6*b* of the lateral side while the apex seal member 3 is pressed against the wall surface 6*b* on one side of the seal groove 4 by the gas pressure P1.

The gas pressure introduced into the chamber 19 to be formed between the bottom part 5 of the apex seal member 3 and the bottom surface 15 of the seal groove 4 is such that the flow resistance offered in the inlet passage 16, the change in volume of the inlet passage 16, the change in the gas pressure P1 itself, etc. cooperate to prevent the top surface 28 of the apex seal member 3 from being pressed with sufficient force against the sliding surface 1 of the rotor housing 20. Thus, there is the possibility that the important force P1A3 for raising the apex seal member 3 into sealing contact with the sliding surface 1 of the rotor housing 20 and keeping the adjacent operating chambers V1 and V2 mutually sealed in an airtight state will be insufficient relative to the force P1A1+P2A2 tending to separate the apex seal member 3 from the sliding surface 1 of the rotor housing 20 and the force $\mu$P1A4 of the frictional resistance concerning the motion of the apex seal member 3 in the radial direction indicated by the arrow 14. Particularly where the radius of curvature of the top surface 28 of the apex seal member 3 is large, namely the height "a" of the arch top surface 28 in the radial direction indicated by the arrow 14 is large, the combustion gas of high pressure P1 acts on the area Al, i.e. a relatively wide area on the top surface 28 of the apex seal member 3 on the front side in the direction of advance relative to the rotation of the rotor 11 indicated by the arrow 13 while the operating chamber V1 in the process of operation for compression and combustion. Thus, there is the possibility that the aforemeniioned force P1A3 will be small as compared with the force, P1Al+P2A2, which is acting on the top surface 28 of the apex seal 3. This is because the part 62 of the arch top surface 28 of the apex seal member 3 which contacts the sliding surface 1 of the rotor housing 20 approaches an apex part 63 of the top surface 28 in consequence of the rotation of the rotor 11 and, as the result, the high pressure P1 of the combustion gas eventually acts on a wide region of the top surface 28. The apex seal member 3 tends to be raised by the aforementioned inertial force, the force P1A3 (lifting force), and the repulsive force generated outwardly in the radial direction indicated by the arrow 14 by the spring 27 serving to lift the apex seal member 3, The force, P1A1+P2A2 acting on the top surface 28 of the apex seal member 3 and the force of frictional resistance, μP1A4, prevent the apex seal member 3 from being sufficiently raised or force it to remain in sealing contact with sliding surface, with the result that a gap will be formed between the top surface 28 of the apex seal member 3 and the sliding surface 1 of the rotor housing 20. The combustion gas of high pressure P1 and the unburnt compressed gas pressed by the combustion gas leak through the gap into the neighboring operating chamber V3 which is in the process of emitting exhaust gas. This leakage possibly lowers the engine output and degrades the efficiency of fuel consumption.

Figure 5:
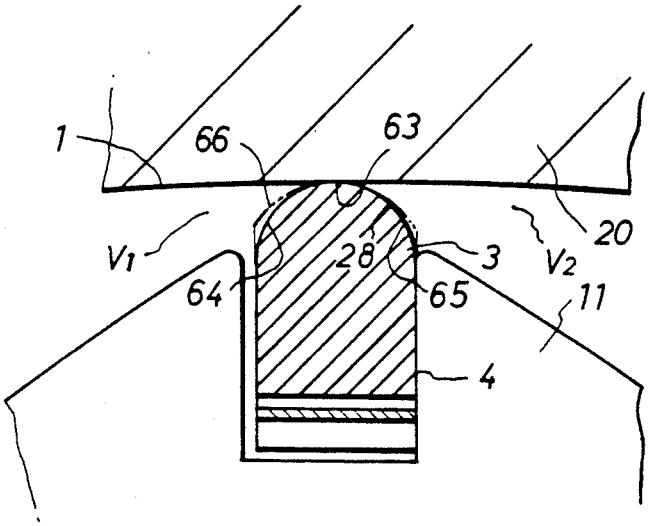

Now, the abrasion of the top surface 28 of the apex seal member 3 will be described below with reference to FIG. 5.

When the apex seal member 3 slides over the sliding surface 1, namely the trochoidal inner wall surface, of the rotor housing 20, the apex part 63 of the top surface 28 of the apex seal member 3 slides over the sliding surface 1 of the rotor housing 20 in a short range and opposite parts 64, 65 of the top surface 28 outside the apex part 63 are liable to slide thereover in a long range. As the result, the top surface 28 of the apex seal member 3 is abraded to a greater depth in the opposite parts 64, 65 outside the apex part 63 as indicated by a two-dot chain line 66 in FIG. 5 and, therefore, is gradually rounded and thinned. The length of the arch of the top surface 28 of the apex seal member 3 gradually increases and the area of the top surface 28 which receives the gas pressure acting on the top surface 28 gradually widens and the depth of the depression of the apex seal member 3 proportionately increases.

The forces which act on the apex seal member and the motion imparted by the forces to the apex seal member have been described. In the rotary engine of this invention, the various forces acting on the apex seal members as described above can be varied to advantage as described below by the improvements contemplated by this invention and embodied in the apex seal members.

Figure 6:
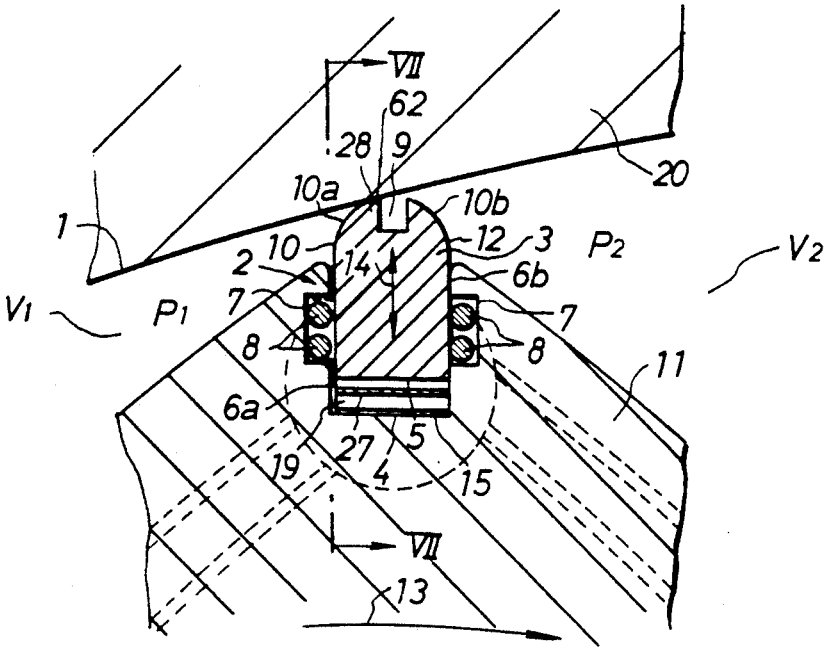
FIG. 6 is a partially sectioned view illustrating as magnified the portion A indicated in FIG. 1 of the rotary engine of this invention fitted with an apex seal member.
Figure 7:
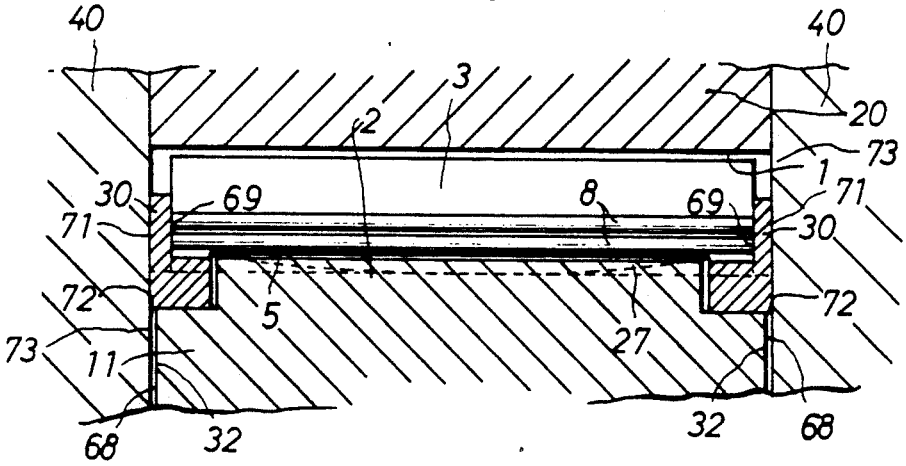
FIG. 7 is a side elevational view for the cross section taken along line VII—VII in FIG. 6.

With reference to FIG. 1, FIG. 6, and FIG. 7, 1 stands for a rotary a sliding surface of the rotor housing 20, 2 for an apex part of the rotor 11, 3 for an apex seal member, 4 for a seal groove, 5 for a bottom part of the apex seal member 3, 6*a* and 6*b* each for a wall surface of the seal groove 4, 8 for a roller, and 30 for a corner seal.

As illustrated in FIG. 1, the rotor 11 revolves around the output shaft P of rotation and, at the same time, rotates on a rotor journal 67 deviating from the center of the output shaft P and the vicinity of the apex parts 2 of the rotor 11 slide over the sliding surface 1 of the rotor housing 20 in a state retaining contact with the sliding surface 1. Thus, the operating chambers V1, V2, and V3 for performing the steps of operation, i.e. suction, compression, combustion, expansion, and exhaust are formed between the sliding surface 1 of the rotor housing 20 and the periphery of the rotor 11. The states of airtightness of these operating chambers V1, V2, and V3, therefore, are maintained by precluding gas leakage through the gap between the apex parts 2 of the rotor 11 and the sliding surface 1 of the rotor housing 20 and the gap between the lateral side 32 of the rotor 11 and a side housings 40 (FIG. 7).

As illustrated in FIG. 6 and FIG. 7, therefore, the seal grooves 4 are formed one each at the apex parts 2 and the apex seal members 3 are disposed one each in the seal grooves 4 so as to preclude the otherwise possible occurrence of the gap between the apex parts 2 and the sliding surface 1. Side seals 68 are disposed on the opposite sides 32 of the rotor 11 and, at the same time, the corner seals 30 are interposed between the apex seal member 3 and the side seals 68 so as to preclude the otherwise possible occurrence of the gap between the lateral sides 32 and the side housings 40. Thus, the mutual airtightness of the operating chambers V1, V2, and V3 is maintained. In the chamber 19 formed between the bottom surface 15 of the seal groove 4 and the bottom part 5 of the apex seal member 3, the spring 27 is disposed so as to press the apex seal member 3 elastically against the sliding surface 1. Groove like depressions 7 are formed one each in the wall surfaces 6*a*, 6*b* of the seal groove 4 opposed respectively to the lateral sides 10, 12 of the apex seal member 3. A plurality of slender rollers 8 are rotatably accommodated in the depressions 7. These rollers 8 are so adapted that they are allowed to maintain rolling contact with the lateral sides 10 and 12 even when the apex seal member 3 is moved relative to the radial direction indicated by the arrow 14 and the lateral sides 10, 12 are exposed to the gas pressure emanating from the operating chamber. Various test results indicate that the number of rollers 8 to be accommodated in each of the depressions 7 is desired to be 2.

Desirably, the rollers 8 are made of a metallic material which is not easily softened or deteriorated by the gas of high pressure and high temperature and is not agglutinated or chemically degenerated by the product of combustion. The inventors have adopted high-speed steel. The rollers 8 generally have a slender shape. Desirably they are formed in the shape of a cylindrical pin having a diameter approximately in the range of 1 to 0.5 mm.

Figure 8:
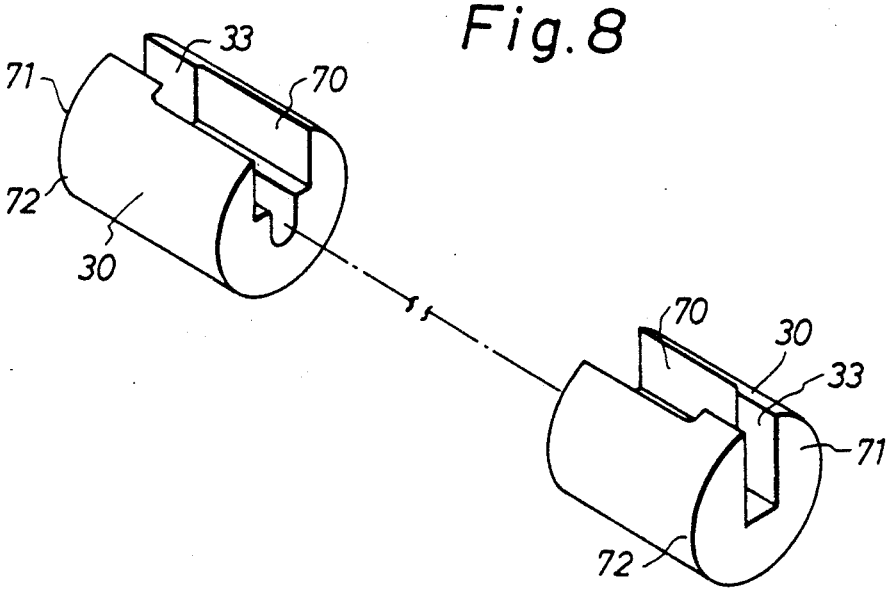
FIG. 8 is a perspective view of corner seals of the rotary engine according with this invention.

The rollers 8 are supported fast in place, as illustrated in FIG. 7, by having the opposite end parts 69 accommodated in the recesses 70 of a pair of corner seals 30 formed as illustrated in FIG. 8 and disposed one each at the opposite end parts of the rotor 11. The corner seals 30 are each provided with a groove 33 for accommodating the apex seal member 3 and are allowed to contact the side seals 68 on the outer wall surfaces 72 of the corner seals 30. The end faces 71 of the corner seals 30 are disposed as juxtaposed to the apex parts 2 at the opposite end parts of the rotor 11 so as to confront and slide over the inner surfaces 73 of the side housings 40.

Figure 9:
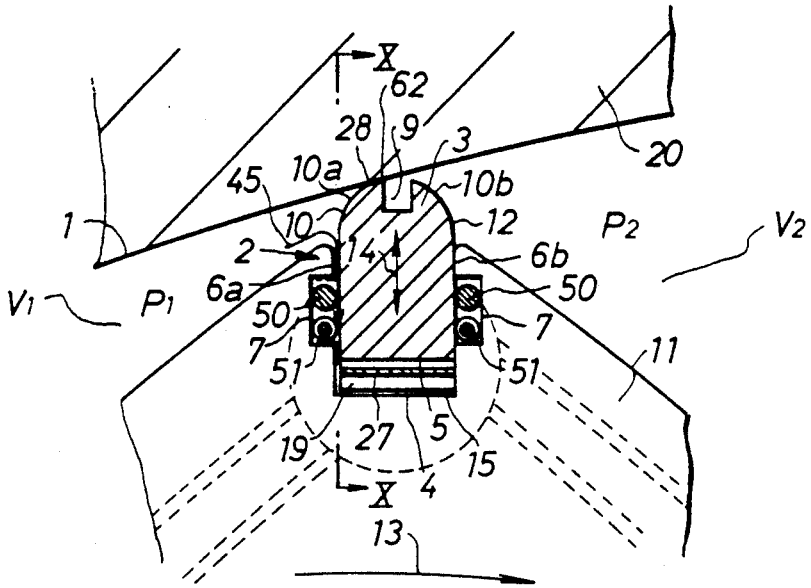
FIG. 9 is a partially sectioned view illustrating as magnified the portion A indicated in FIG. 1 of the rotary engine of the present invention fitted with other roller members for an apex seal member.
Figure 10:
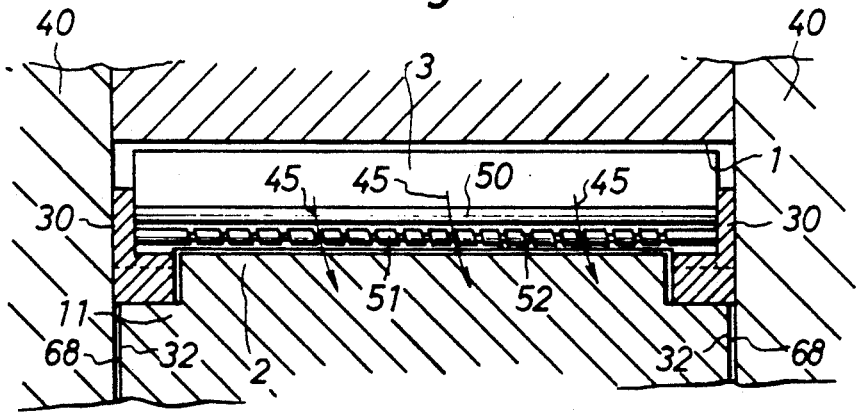
FIG. 10 is a side elevational view for the cross section taken along line X—X in FIG. 9.

The rollers 8 are set inside the depressions 7 formed one each in the wall surface 6*a*, 6*b* of the seal groove 4 and adapted to rotatably contact the apex seal member 3 and enable the apex seal member 3 to be smoothly moved in the radial direction indicated by the arrow 14 even when the apex seal member 3 is pressed against the wall surface 6b the combustion gas pressure P1 of high magnitude. Optionally, the rollers 8 may be constructed as illustrated in FIG. 9, FIG. 10, and FIG. 11, so as to ensure introduction of the gas pressure P1 into the chamber 19 of the seal groove 4.

Figure 11:
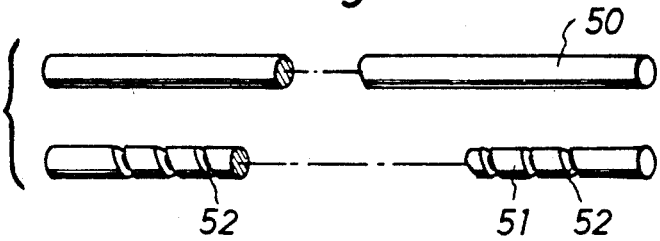
FIG. 11 is a perspective view of roller members.

Specifically, a pair of rollers formed by combining a roller 50 and a roller 51 as illustrated in FIG. 11 may be used in the place of the aforementioned plurality of rollers 8. The roller 50 on the upper side has the same shape as the roller 8. The roller 51 on the lower side is a grooved roller having a groove 52 formed on the outer periphery surface thereof. A plurality of grooves may be parallel or one groove may be formed spirally.

The roller 50 on the upper side is so adapted that when the apex seal member 3 is pressed by the gas pressure P2 against the wall surface 6a on one side of the seal groove 4, it will contact the wall surface 6a and the lateral side 10 of the apex seal member 3 and give rise to an airtight part and aid in the prevention of gas leakage.

The roller 51 on the lower side is so adapted that when the apex seal member 3 is pressed against the wall surface 6b on one side of the seal groove 4 by the gas pressure P1, the groove 52 in the roller 51 forms a gas passage indicated by the arrow 45 and enables the gas pressure P1 to be introduced into the chamber 19 in the seal groove 4. If, in the present embodiment, the upper roller 50 and the lower roller 51 are both cylindrical rollers similarly to the rollers 8, while the upper roller 50 is enabled to move toward either of the opposite sides, namely the depression 7 and the lateral side 10 of the apex seal member 3, and give rise to a gap capable of passing gas owing to the gap between the roller 50 itself and the depression 7 and the lateral side 10 of the apex seal member 3, the lower roller 51 possibly comes into fast contact with the bottom part of the depression 7 and the lateral side 10 of the apex seal member 3 and fails to form a gas passage when the chamber 19 of the seal groove 4 is in the state of low pressure and is exposed to the action of the high-pressure gas entering the seal groove 4 through said gap of the upper roller 50.

To avoid this possible misfortune, the lower roller 51 is so constructed so to form the groove 52 and the outer periphery surface thereof and ensure provision of a gas passage.

Since the apex seal member 3 has the lateral sides 10, 12 thereof supported in place rotatably by the rollers 50, 51 as described above, it is enabled to move smoothly relative to the radial direction indicated by the arrow 14 even when the pressure of the gas emanating from the operating chamber strongly presses the lateral sides 10, 12 against the wall surfaces 6a, 6b of the seal groove 4. Moreover, since the gas from the operating chamber is infallibly introduced into the chamber 19 of the seal groove 4 through the groove 52 formed on the outer periphery surface of the roller 51, the apex seal member 3 is pushed up by the pressure of the incoming gas without fail outwardly relative to the radial direction indicated by the arrow 14.

Figure 12:
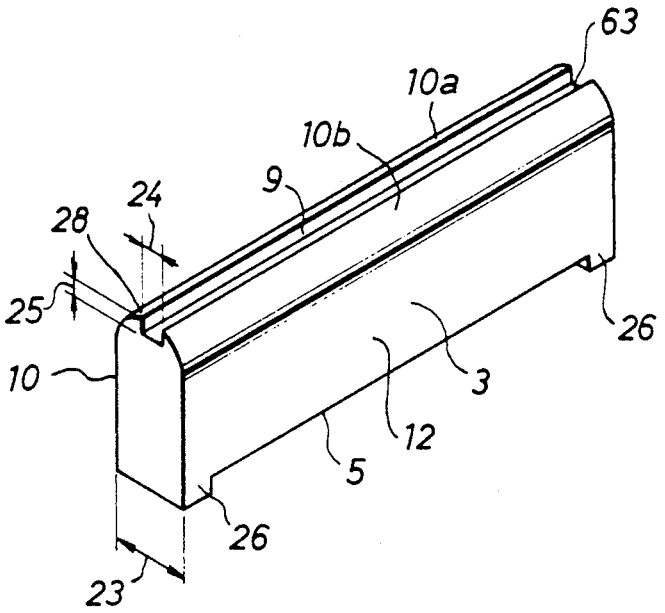
FIG. 12 is a perspective view of an apex seal member.

Further, in the arch apex part 63 on the top surface 28 of the apex seal member 3, a recess 9 is formed along the direction in which the axis of rotation of the rotor 11 is extended as illustrated in FIG. 12. Desirably, this recess 9 is constructed so that the width 24 thereof will fall in the range of 1/6 to ⅓ (0.5 to 1.0 mm) of the thickness 23 of the apex seal member 3 and the depth 25 thereof will fall in the range of 1.0 to 1.5 mm. The radius "a" of the arch part of the top surface 28 embracing the recess 9 (FIG. 3) is desired to be not less than 1.5 mm, a size larger than that of the apex seal member 3 of ordinary run.

The top surface 28 of the apex seal member 3 in which the recess 9 is formed is divided into two rounded surfaces 10a, 10b formed on the opposite sides of the arch apex part 63 as opposed to each other across the recess 9.

The apex seal member 3 is provided on the bottom part 5 thereof with protrusions 26 intended to facilitate the positioning of the apex seal member 3 relative to the direction of the aforementioned extension of the axis of rotation when the apex seal member 3 is fitted in the seal groove 4 formed in the rotor 11.

While the rotor 11 is rotating inside the rotor housing 20, the angles of vibration of the apex seal members 3 relative to the sliding surface 1 of the rotor housing 20 vary and the parts 62 in which the two rounded surfaces 10a, 10b contact the sliding surface 1 of the rotor housing 20 vary. In other words, the two rounded surfaces 10a, 10b alternately come into contact with the sliding surface of the rotor housing 20. Particularly when the operating chamber V1 is in the initial process of combustion, the apex seal member 3 positioned on the front side of the operating chamber V1 relative to the direction of rotation of the rotor 11 has the rounded surface 10a held in sliding contact with the sliding surface 1 of the rotor housing 20 as illustrated in FIG. 6. As the rotation of the rotor 11 further proceeds from this state, the part 62 of contact gradually shifts to the rounded surface 10b (toward assuming the state of FIG. 13).

since the top surface 28 of the apex seal member 3 which is exposed to the action of the high-pressure gas of the operating chamber V1 in the process of combustion and expansion is provided with the recess 9, it has the rounded surface 10a first held in sliding contact with the sliding surface 1 of the rotor housing 20. While the top surface 28 is in this state, the part of a very narrow area faces the side of the operating chamber V1 now held in the state of high pressure (FIG. 6) and the recess 9 and the rounded surface 10b on the other side of the part of contact 62 face the operating chamber V2 now in the process of exhaustion. Thus, the gas of high pressure is acting on the part of narrow area and the gas of relatively low pressure on the part of relatively wide area embracing the recess 9 and the rounded surface 10b.

Figure 13:
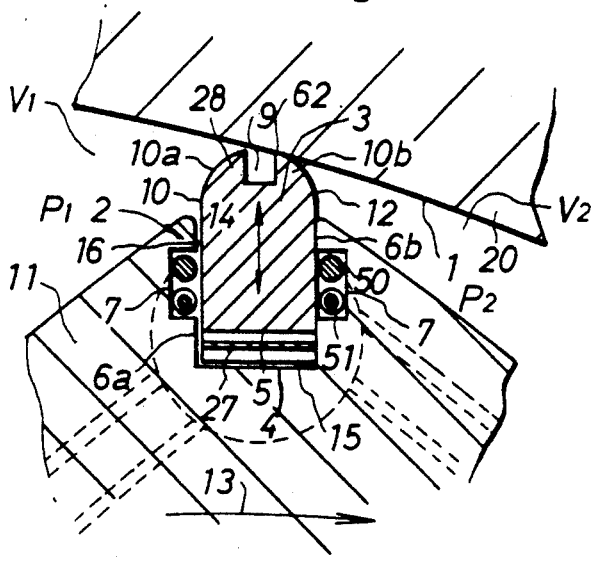
FIG. 13 is an explanatory diagram illustrating the manner of exertion of gas pressure upon an apex seal member in the rotary engine.

When the rotor 11 is further rotated and part of contact 62 moves past the recess 9 of the top surface 28 and assumes a position on the rounded surface 10b as illustrated in FIG. 13, the pressure of the gas acting on the rounded surface 10a and the recess 9 is relatively low.

As the result, the force tending to depress the apex seal member 3 toward the bottom surface 15 of the seal groove 4, namely inwardly in the radial direction indicated by the arrow 14 can be repressed to a small magnitude. The force which is generated by the pressure of the gas introduced via the passage 16 and is exerted upon the bottom part 5 of the apex seal member 3 in the direction of pushing up the apex seal member 3 outwardly in the radial direction indicated by the arrow 14, therefore, surpasses the pressing force tending to depress the apex seal member 3 as described above. As the result, the top surface 28 of the apex seal member 3 is pressed so fast against the sliding surface 1 of the rotor housing 20 that the airtight contact established therebetween can be safely retained.

Figure 14:
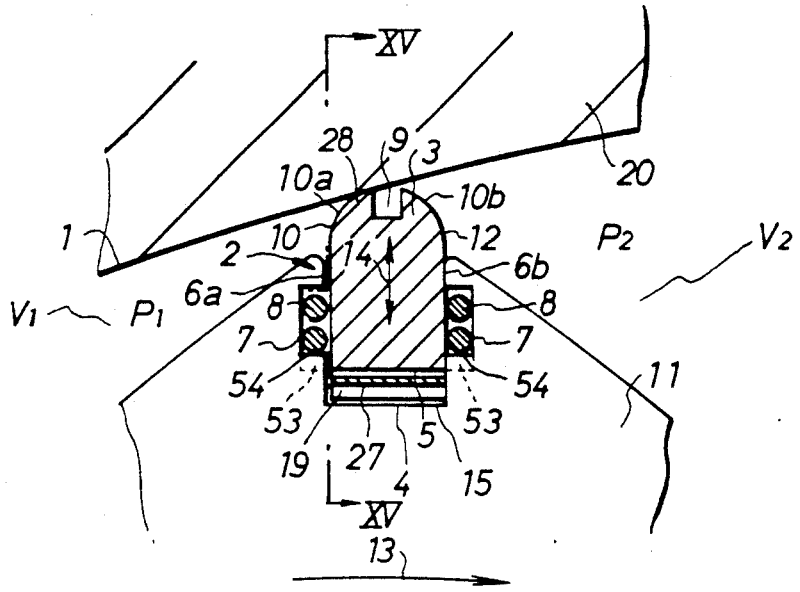
FIG. 14 is a partially sectioned view illustrating as magnified the portion A indicated in FIG. 1 of another typical rotary engine as the second embodiment of this invention.
Figure 15:
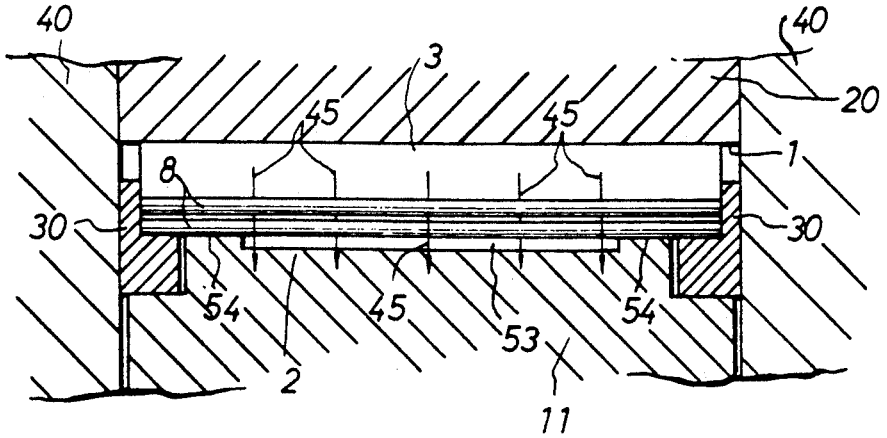
FIG. 15 is a side elevational view for the cross section taken along line XV—XV in FIG. 14.

In the place of the construction which ensures safe introduction of the gas from the operating chamber into the chamber 19 of the seal groove 4 through the medium of the groove 52 formed on the outer periphery surface of the roller 51 as illustrated in FIG. 9 and FIG. 13, this invention further contemplates a construction which places in the depressions 7 formed in the seal groove 4 of each of the apex parts 2 of the rotor 11 such rollers 8 as formed in the shape of a cylindrical pin similarly to the rollers used in the embodiment of FIG. 6 and FIG. 7 and forms in the bottom parts 54 of the depressions 7 supporting the rollers 8 such recess 53 as adapted to communicate with the chamber 19 of the seal groove 4 as illustrated in FIG. 14 and FIG. 15 and warrants the safe introduction of the gas from the operating chamber into the chamber 19 of the seal groove 4 through the medium of the recess 53.

Figure 16:
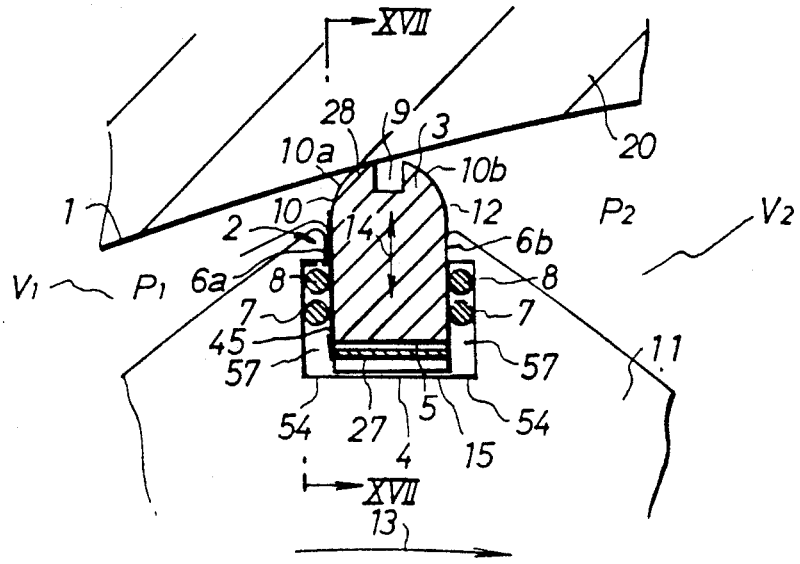
FIG. 16 is a partially sectioned view illustrating as magnified the portion A indicated in FIG. 1 of yet another typical rotary engine as the third embodiment of this invention.
Figure 17:
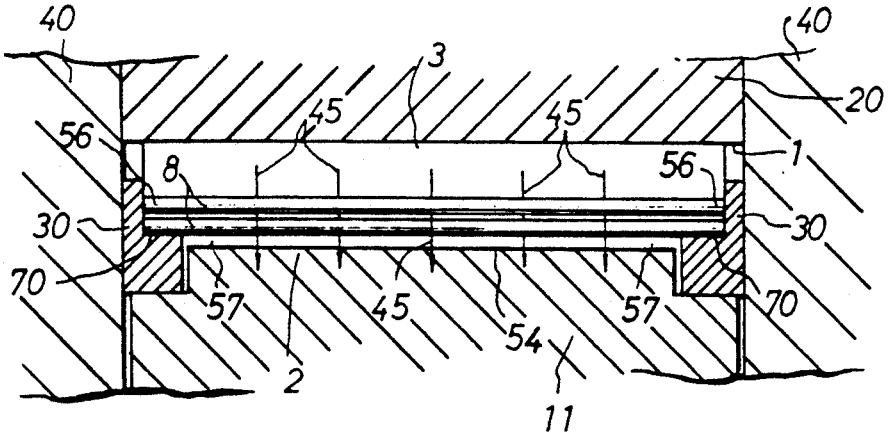
FIG. 17 is a side elevational view for the cross section taken along line XVII—XVII in FIG. 16.

In the place of the construction of the embodiment illustrated in FIG. 9 and FIG. 13, as shown in FIG. 16 and FIG. 17, the present ivnention further contemplates a construction in which the grooves 70 of the corner seals 30 illustrated in FIG. 8 disposed as opposed to the opposite, corresponding to the end parts 56 of a plurality of rollers 8 are adapted to support the rollers 8 and the depressions 7 are formed so that gaps 57 will occur between the rollers 8 and the bottom parts 54 of the depressions 7 while the rollers are held in the grooves 70 as described above. The gaps 57 are created throughout the entire areas of the depressions 7 relative to the longitudinal direction of the rotor 11 and allowed to communicate with the chamber 19 of the seal groove 4. The introduction of the gas indicated by the arrow 45 from the operating chamber to the chamber 19 of the seal groove 4 is ensured through the medium of the gaps 57.

Figure 18:
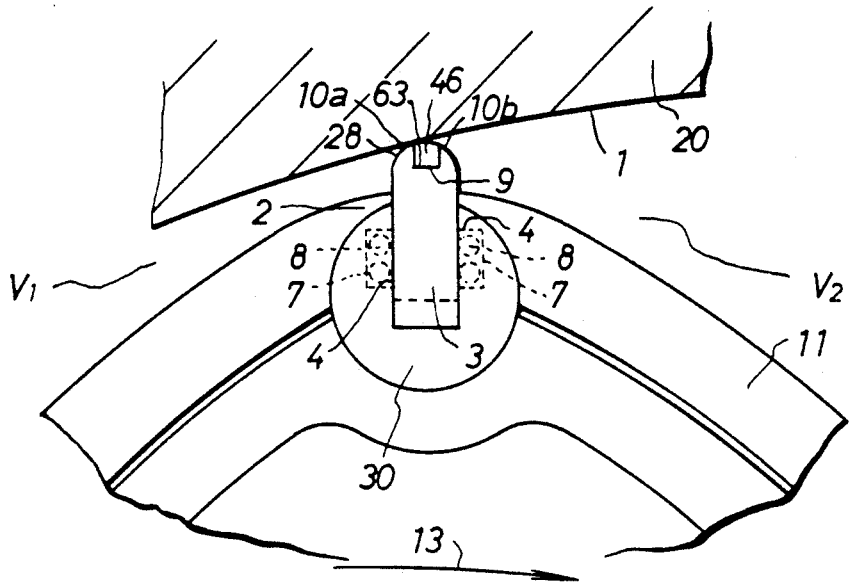
FIG. 18 is a partially sectioned view illustrating as magnified the portion A indicated in FIG. 1 of still another typical rotary engine as the fourth embodiment of this invention.
Figure 19:
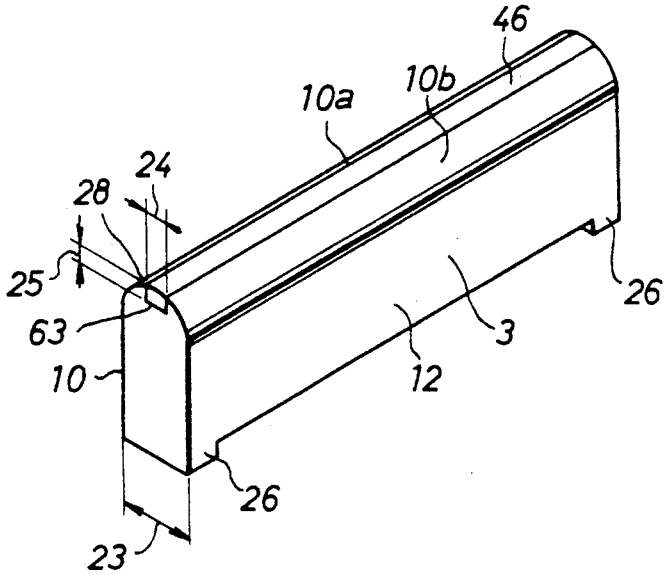
FIG. 19 is a perspective view illustrating an apex seal member used in the embodiment of FIG. 18.

The apex seal member 3 may be constructed so that a packing material 46 capable of being relatively easily abraded by the sliding contact with the sliding surface 1 of the rotor housing 20 is embedded in the recess 9 formed at the arch apex part 63 in the top surface 28 of the apex seal member 3 as illustrated in FIG. 18 and FIG. 19. This packing material 46 enables the apex seal member 3 to retain contact of added fastness with the sliding surface 1 of the rotor housing 20 to ensure maintenance of improved mutual airtightness of the adjacent operating chambers, e.g. the operating chambers V1 and V2. This packing material 46 is desirably formed of a relatively soft metallic substance.

What is claimed is:

1. A rotary engine having an apex seal member, comprising:

a rotor housing having an inner wall surface;

a rotor disposed rotatably in said rotor housing so as to define a plurality of operating chambers in cooperation with the inner wall surface of said rotor housing, said rotor having an axis of rotation and having apexes and seal grooves formed in said apexes respectively, along a direction of said axis of rotation of said rotor; and an apex seal member formed as a substantially rigid solid body with respect to a rotating direction of the rotor and with respect to a radial direction of the rotor and formed as one piece with respect to the rotating direction of the rotor and with respect to the radial direction of the rotor, said apex seal member being accommodated inside one of said seal grooves, and said apex seal member having a recess extending along the direction of said axis of rotation of said rotor, said recess being formed in the top portion of said apex seal member.

2. A rotary engine having an apex seal member according to claim 1, and further comprising pressing means disposed between said apex seal member and said rotor so as to press said apex seal member against said inner wall surface of said rotor housing by virtue of the pressure of a gas emanating from said operating chambers.

3. A rotary engine having an apex seal member according to claim 1, wherein said seal grooves have inner wall surfaces and said apex seal member has lateral sides, said rotary engine further comprising means for reducing frictional resistance between said lateral sides of said apex seal member and said inner wall surfaces of said seal grooves so as to decrease said frictional resistance generated between said lateral sides and said inner wall surfaces.

4. A rotary engine having an apex seal member according to claim 2, wherein said inner wall surfaces of said seal groove includes lateral wall surfaces and said means for reducing frictional resistance comprises grooves formed in the lateral wall surfaces of said seal groove and a plurality of roller members accommodated in said grooves and disposed along the direction of extension of said grooves.

5. A rotary engine having an apex seal member according to claim 2, wherein said apex seal member has a bottom part and said pressing means is provided with a gas passage means disposed between said seal groove and said apex seal member for enabling gas pressure emanting from said operating chambers to act on said bottom part of said apex seal member.

6. A rotary engine having an apex seal member according to claim 5, wherein said seal groove includes lateral wall surfaces and a bottom wall surface, and said apex seal member has lateral sides, said gas passage means comprising gaps formed between the lateral sides of said apex seal member and the lateral wall surfaces of said seal groove, and a chamber disposed between the bottom part of said apex seal member and the bottom wall surface of said seal groove.

7. A rotary engine having an apex seal member according to claim 5, wherein said gas passage means is further provided with grooves formed in the lateral wall surfaces of said seal groove, said grooves accommodating a plurality of roller members, and a hollow formed in the bottom wall surface of said seal groove forming gaps between said grooves and said roller members.

8. A rotary engine having an apex seal member according to claim 5, and further comprising means for reducing frictional resistance between the lateral sides of said apex seal member and inner wall surfaces of said seal groove, said frictional resistance reducing means comprising grooves formed in the lateral wall surfaces of said seal groove and a plurality of roller members accommodated in said grooves and disposed along the direction of extension of said grooves and having an outer periphery surface, said gas passage means further comprising a groove-shaped part formed on the outer periphery surface of at least one of said roller members.

9. A rotary engine having an apex seal member according to claim 1, wherein said top portion of said apex seal member comprises a convex surface, said recess being disposed substantially centrally of said convex surface so as to form two rounded surfaces on either side of said recess, said rounded surfaces alternately coming into sliding contact with said inner wall surface during rotation of said rotor.

* * * * *